US012336576B2

(12) United States Patent
Monica

(10) Patent No.: US 12,336,576 B2
(45) Date of Patent: Jun. 24, 2025

(54) PADDING FOR PROTECTIVE EQUIPMENT

(71) Applicant: XTECH Protective Equipment, LLC, East Hanover, NJ (US)

(72) Inventor: Theodore Anthony Monica, East Stroudsburg, PA (US)

(73) Assignee: XTECH Protective Equipment, LLC, East Hanover, NJ (US)

( * ) Notice: Subject to any disclaimer, the term of this patent is extended or adjusted under 35 U.S.C. 154(b) by 12 days.

(21) Appl. No.: 18/080,473

(22) Filed: Dec. 13, 2022

(65) Prior Publication Data

US 2023/0180860 A1 Jun. 15, 2023

Related U.S. Application Data

(60) Provisional application No. 63/288,760, filed on Dec. 13, 2021.

(51) Int. Cl.
*A63B 71/08* (2006.01)
*A41D 13/015* (2006.01)

(52) U.S. Cl.
CPC ..... *A41D 13/015* (2013.01); *A63B 71/08* (2013.01)

(58) Field of Classification Search
CPC ..... A41D 13/015; A63B 2071/1208; A63B 71/08; A63B 71/12
See application file for complete search history.

(56) References Cited

U.S. PATENT DOCUMENTS

| | | | | |
|---|---|---|---|---|
| 817,656 | A * | 4/1906 | McCalla | A41D 13/0158 2/462 |
| 5,020,156 | A * | 6/1991 | Neuhalfen | A63B 71/12 2/92 |
| 10,959,476 | B2 * | 3/2021 | Turner | A41D 13/015 |
| 2013/0269075 | A1 * | 10/2013 | Boye | A41D 13/08 2/16 |

* cited by examiner

*Primary Examiner* — Sally Haden
(74) *Attorney, Agent, or Firm* — Nikitas E. Nicolakis; Lombard & Geliebter LLP

(57) ABSTRACT

A pad for protective equipment is provided, the pad includes a foam layer having a generally cantilever shape with an inner face and an outer face opposite the inner side, a top and a bottom opposite the top, and a medial end and a lateral end opposite the medial end, wherein at least one of the inner face and the outer face includes at least one vertical depression extending between at least a portion of the top bottom and the bottom of the foam layer, and extending through to the bottom of the foam layer, the foam layer further having at least one a slotted aperture therein extending through the inner face and the outer face, the at least one depression interesting with the at least one slotted aperture.

14 Claims, 14 Drawing Sheets

PADDING FOR PROTECTIVE EQUIPMENT

RELATED APPLICATION

This application claims priority to U.S. Provisional Application No. 63/288,760, filed on Dec. 13, 2021, entitled "PADDING FOR PROTECTIVE EQUIPMENT," which is hereby incorporated by reference in its entirety.

BACKGROUND OF THE INVENTION

The present application generally relates to athletic protective equipment, and in particular, improved padding system for shoulder pads and the like.

Many contact sports, such as football, require protective devices to guard against injury from the violent bodily contact that may be involved. One of the customary protective devices in contact sports is specialized equipment in the form of shoulder pads. Shoulder pads have long been known and used, but to counteract the high forces encountered when playing such sports, designers use relatively thick padding systems, which limit player movement and limit heat dissipation. Moreover, padding systems are known to absorb moisture, increasing the weight of the protective equipment and thus increases player fatigue. Accordingly, there is a need for protective equipment that is better able to handle heat and/or moisture during gameplay.

SUMMARY OF THE INVENTION

In one aspect, a pad for protective equipment is provided, the pad includes a foam layer having a generally cantilever shape with an inner face and an outer face opposite the inner side, a top and a bottom opposite the top, and a medial end and a lateral end opposite the medial end, wherein at least one of the inner face and the outer face includes at least one vertical depression extending between at least a portion of the top bottom and the bottom of the foam layer, and extending through to the bottom of the foam layer, the foam layer further having at least one a slotted aperture therein extending through the inner face and the outer face, the at least one depression interesting with the at least one slotted aperture.

In one embodiment, the foam layer includes at least one diagonal depression and wherein the at least one vertical depression intersects with the at least one diagonal depression.

In one embodiment, the foam layer includes at least one diagonal depression and wherein the at least one diagonal depression is oriented downward medially toward the center of the foam layer.

In one embodiment, the foam layer includes at least one diagonal depression and wherein the at least one diagonal depression is oriented upward medially away from the center of the foam layer.

In one embodiment, the foam layer includes a plurality of diagonal depressions and wherein at least one of the plurality of vertical depression intersects with the at least one diagonal depression and wherein at least one other of the plurality of diagonal depressions does not intersect with the at least one vertical depression.

In one embodiment, the at least one of the plurality of diagonal depressions extends to the lateral end and wherein the other of the plurality of diagonal depressions extends to the medial end.

In one embodiment, the pad further includes a deltoid cover hingedly coupled to the foam layer, wherein the deltoid cover includes at least one depression therein extending radially outward from the pad.

In one embodiment, the foam layer includes a second vertical depression on an opposite face from the at least one vertical depression, the second vertical depression extending between at least a portion of the top bottom and the bottom of the foam layer, and extending through to the bottom of the foam layer, the second depression interesting with the at least one slotted aperture.

In one embodiment, the at least one slotted aperture is surrounded at least partially by a slotted flange.

In one embodiment, the foam layer includes a second vertical depression, and wherein the foam layer has a plurality of the slotted apertures, including a first set of slotted apertures arranged in a first column and a second set of slotted apertures arranged in a second a column, wherein at least one of the first set of slotted apertures intersect with the at least one vertical depression, and wherein at least one of the second set of slotted apertures intersect with the second vertical depression.

In one embodiment, at least one of the first set of slotted apertures has a flange that intersects with a flange of at least one of the second set of slotted apertures to form a V shape.

In one embodiment, at least one of the first set of slotted apertures is parallel to at least one of the second set of slotted apertures.

In one embodiment, the foam layer includes a plurality of vertical depressions and a plurality of diagonal depressions forming a tributary network extending laterally and medially for wicking moisture.

In one embodiment, the tributary network intersects to form a crosshatch pattern.

In one embodiment, the pad includes a hook and loop area removably connecting the pad to another pad extending over a user's shoulder.

In one embodiment, the pad further includes a plurality of layers including an inside layer and an outside layer, and wherein the foam layer is disposed between the inside and outside layer.

In one embodiment, the slotted aperture has a flange that is formed by welding the inside layer to the outside layer.

In one embodiment, the foam layer includes at least one diagonal depression and wherein the at least one vertical depression intersects with the at least one diagonal depression, and wherein the at least one diagonal depression does not intersect the at least one slotted aperture.

DETAILED DESCRIPTION OF THE INVENTION

Figure 1:
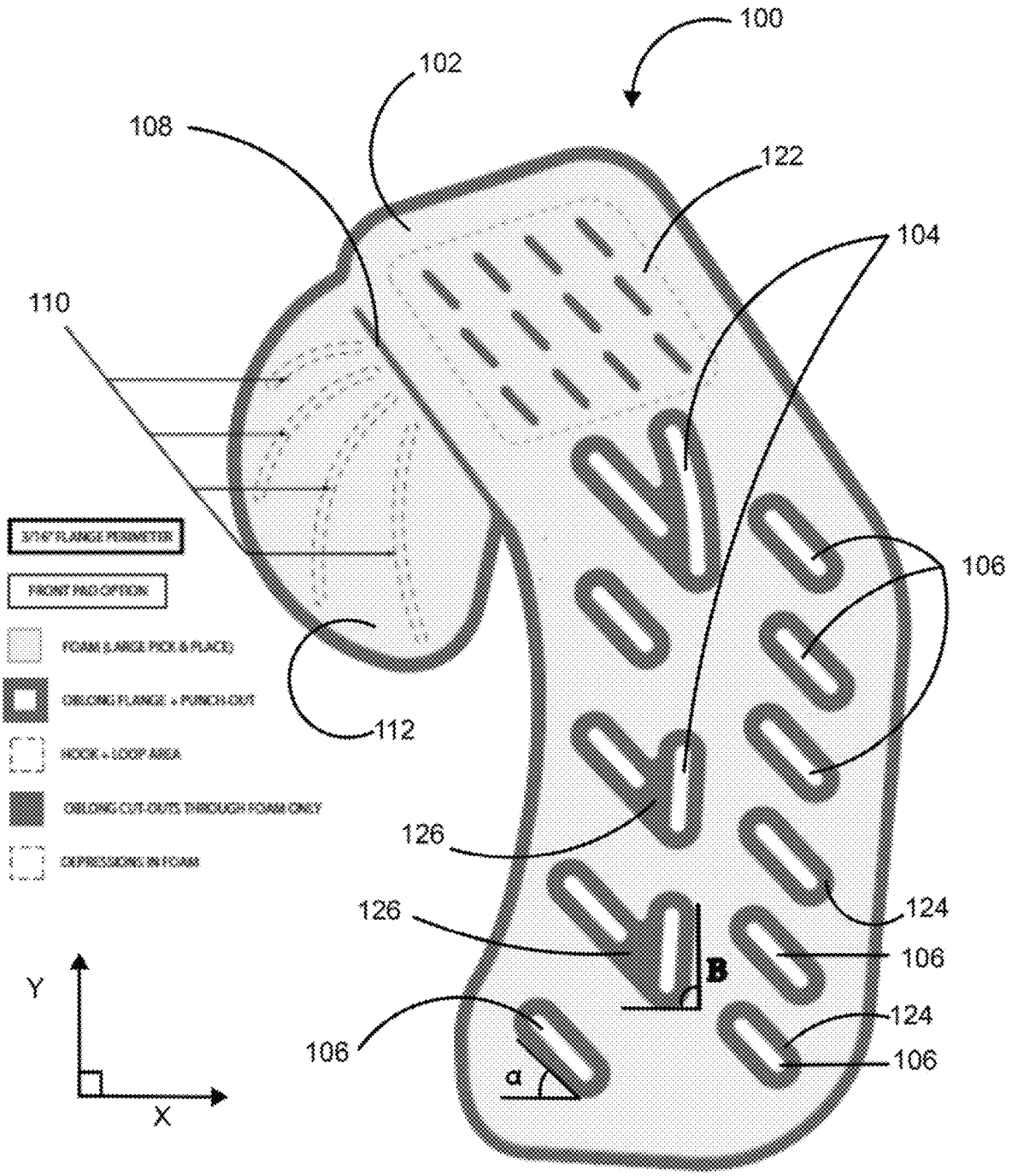
FIG. 1 is a plan view showing a front pad according to at least one embodiment of the pads disclosed herein for use with protective equipment.

FIGS. 1-14 present various views of the padding system according to the several embodiments of the systems disclosed herein. The padding system may be used in conjunction with the Protective Apparatus disclosed in U.S. Pat. No. 10,517,336, which is incorporated herein by reference.

The padding system generally includes at least one of a left-front, right-front, left-rear, and/or right-rear body pads. These pads are generally referred to herein as body pads. FIGS. 1-14 generally show a right-front body pad 100. The left-front body pad may be a mirror image of the right-front body pad, and the rear pads may be mirror images of the front pads, except that the rear pads may be produced without the deltoid cover.

The body pad 100 generally includes a layer of foam 102, preferably formed in the cantilever shape shown. That is, the pad 100 has a lower portion that is essentially vertical (Y axis) and curves at the upper portion thereof left or right, as the case may be, to accommodate the opening for the player's neck and to cover the front and rear of the player's shoulder/lower deltoid. Front body pads 100 may include a deltoid cover 112, extending distally from the upper portion of the pad 100. The deltoid cover 112 is preferably coupled to the front pad 100 via hinge 108. In the embodiment illustrated in FIG. 1, hinge 108 substantially bifurcates a right and left portion of the deltoid cover 112. The hinge 108 shown in FIG. 1, runs primarily from the bottom of the deltoid cover almost to the top of deltoid cover, for example, 80%-95% thereof.

An important function of the deltoid cover 112 is to protect the shoulder joint during stabilization by preventing subluxation or even dislocation of the head of the humerus, particularly when responding to a forceful impact. In addition, deltoid cover 112 is designed to protect shoulder abduction movement when the heads of the deltoid work together to produce said movement. On the side of hinge 108, the deltoid cover 112 may further include depressions 110 in the foam. As shown in FIG. 1, four depressions 110 generally form an arc shape running substantially the remaining length of the deltoid cover 112. As discussed further below, the orientation of the depressions (down and outward), as well as the arcuate shape, assists with heat and moisture dissipation. Although not shown, the depressions in the deltoid cover 112 may intersect with apertures, as with the slotted cut-outs discussed below. The upper portion of the pad 100 may include a means for releasably connecting the pad 100 to the outer shell of the shoulder pads or to another pad 122, such as hook and loop fastening systems, snaps, etc.

The pad 100 may be part of a three part padding system, as discussed in U.S. Pat. No. 11,383,149, which is incorporated herein by reference. In this regard, the pad 100 may include hook and loop fastening system that removably attaches a front and rear pad 100 (on each side of the shoulder pads) to a pad that extends over the user's shoulder and ties the front and rear pad together in a variable configuration, as discussed in U.S. Pat. No. 11,383,149.

The foam may be high or medium density, preferably a microcellular urethane foam, such as Poron®. Various thicknesses may be used, including from about 0.125 inch to about 1.5 inch, or more, depending on the properties of the foam and the desired energy absorption characteristics. Preferably, the foam is encapsulated and/or sandwiched between and/or laminated to low or no permeability layers of polymeric material, including without limitation polyvinyl chloride (PVC), low-density polyethylene, polypropylene, polyethylene terephthalate (PET), silicone, ethyl vinyl alcohol (EVOH), ethylene vinyl acetate (EVA), polyurethane, etc. The low or no permeability layers may further include a fabric outer face to enhance comfort, preferably made of synthetic material.

Referring to FIG. 1, the pad 100 preferably includes a plurality of apertures or punch-outs therein 104, 106. The apertures allow heat and moisture to dissipate. The apertures may be formed in a variety of ways, such as die cutting, etc. In one embodiment, the pad 100 includes at least one slotted aperture oriented vertically 104. That is, the orientation ($\beta$) of the slot 104 is essentially vertical, e.g., +/−10 degrees. In one embodiment, the pad 100 further includes slotted aperture 106, preferably about 30 to about 60 degrees, or more preferably about 45 degrees ($\alpha$) relative to the vertical slot 104 orientation ($\beta$). The combination of vertical and diagonal slots permits better heat and moisture dissipation regardless of the orientation of the player using the pad 100, that is, whether the player is standing, kneeling, supine, or prone positions. The slots 104, 106 may have a flanged perimeter 124, as shown. The pad 100 may further include depressions 110 in the pad 100 to further wick away moisture. The depressions at the deltoid cover 112, for example, may be oriented outward and downward, as shown, to direct moisture in the given direction away from the user. Vertical and diagonal slots 104, 106 may intersect therewith sharing flanges 126. The flanges may be located approximately halfway into the thickness of the foam.

As shown in FIG. 1, there may be a plurality of slotted cut-outs partially through the foam material or in a multilayer system through the foam material only. That is, pad 100 may be made of a plurality of layers with the foam material making up an inside layer. In this regard, the cutout may be formed in the foam material only, thereby forming depressions appearing on the outer layers. Alternatively or additionally, the oblong cut-outs may include punch-outs entirely through the pad 100 that form the slots 104, 106. The punch-outs may be surrounded by the flanges, as discussed above. That is, a plurality of layers of material, for example, may be welded together, without foam therebetween, to form the flanges 124, 126 that encapsulate the foam within the layers. The oblong/slotted cut-outs/punch-outs 104, 106 may be formed in a plurality of rows. In the particular embodiment depicted in FIG. 1, the punch-outs 104, 106 are formed in three columns. In other embodiments, the slotted punch-outs may be oriented vertically or horizontally. The material within oblong flanges 106 in FIG. 1 may be fully punched out. Preferably, at least one of the columns has slotted cut-outs/punch-outs that have an orientation (plan view) that is different from the orientation of another column of slotted cut-outs/punch-outs. Preferably, at least one of the columns has slotted cut-outs/punch-outs that have an orientation (plan view) that is the same as the orientation of another column of slotted cut-outs/punch-outs. Preferably, the columns with the slots in the same orientation have a plurality of slots that are parallel.

Figure 2:
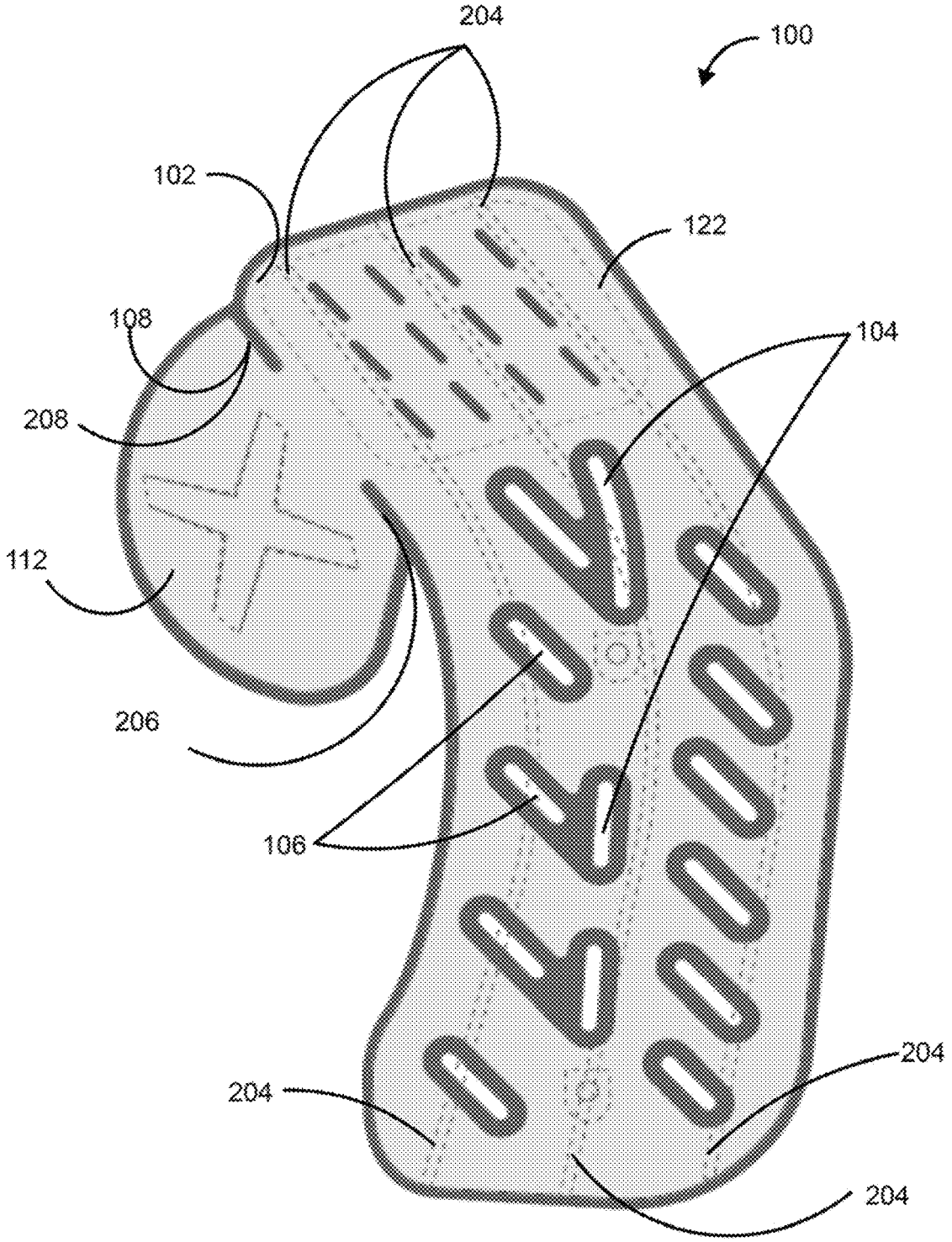
FIG. 2 is a plan view showing a front pad according to at least one other embodiment of the pads disclosed herein for use with protective equipment.

Referring to FIG. 2, the pad 100 may further include a plurality of essentially vertical depressions 204. The depressions disclosed herein may be located on the inside or outside faces of the pad 100, or preferably both. The depressions 204 generally follow the shape of the pad 100. Preferably, the depressions 204 extend from a top end to the bottom end of the pad 100, as shown. That is, the depressions 204 have a curved shape with the concavity facing outward, as shown, for the pad 100, to wick moisture down and out from the user. Preferably, depressions 204 communicate or open into the slots 104, 106. Beneficially, this arrangement allows moisture to be directed by the depressions 204 into the slots 104, 106 and thus outward from the padding system. For example, when the player is in the three point stance position, gravity will cause moisture from the inside face of the shoulder pads (closest to the player's skin) to be diverted by the depressions 204 (on the inside face of the pad 100) to the slots 104, 106. The pads 100 are attached directly to the inside of the shoulder pad shell, in which instance the depressions (shaped as channels) may be enclosed loosely with the shell to prove a conduit for moisture to flow through. The depth of the depression(s) may vary, but are generally less than 50%, or preferably less than 30% of the thickness of the foam 102. In this regard, the outer face of the pad 100 drops in a first step into the depth of the depression 204 and in a second step at the intersection of the depression 204 with the slots 104, 106 into the depth of the slots 104, 106. In this embodiment, hinge 108 includes two segments. 206, 208. The first hinge segment 208 runs from the top portion of deltoid cover and the second hinge segment 206 runs from the bottom portion of deltoid cover, with about 40%-60% of the foam continuous between the deltoid cover and the body of pad 100.

Figure 3:
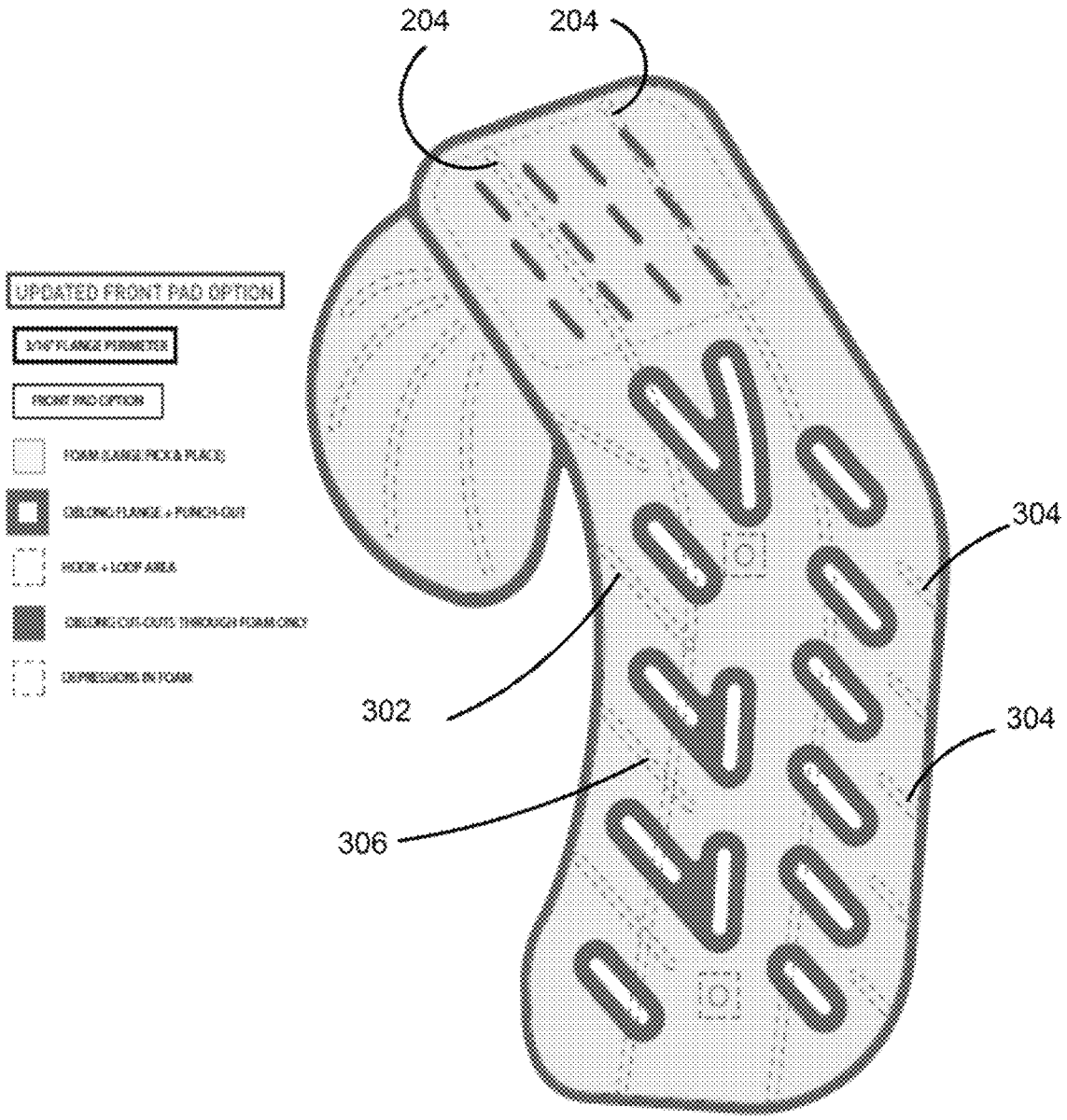
FIG. 3 is a plan view showing a front pad according to at least one other embodiment of the pads disclosed herein for use with protective equipment.

Referring to FIG. 3, the pad 100 may further include diagonal depressions 302. That is, the depressions 302 are preferably about 30 to about 60 degrees, or more preferably 45 degrees relative to (Y axis). The diagonal depressions herein may be located on the inside or outside faces of the pad 100, or preferably both. The diagonals may be oriented downward medially toward the center of the shoulder pads, as shown. The depressions 302 may be parallel and/or non-parallel (radially disposed) to each other, or a combination thereof, as shown. The depressions 302 may be diagonal in such that the upper end is distal relative to the lower end (as shown in FIG. 3) or preferably in the opposite direction (as shown in FIGS. 7-14) so that moisture wicks away from the user. Preferably, depression 302 communicates or opens into the depression 204 and/or slots 104, 106. In this embodiment, the diagonal depressions 302 extend from the outside perimeter of the pad 100 partially in toward the middle of the shoulder pad, as shown. As also shown, some of the diagonal depressions 306 may extend beyond the vertical depressions 204 and therefore intersect the vertical depressions 204 from two directions. Preferably, the pad 100 includes two rows of diagonal depressions 302, including an outer row and an inner row relative to the center of the shoulder pad to which the pad 100 will be installed. The vertical depressions 204 preferably intersect the diagonal and/or vertical slots 104, 106. The outer row of depression 302 preferably intersects at least one of the vertical depressions 204, whereas the inner row of depressions may not intersect with any of the vertical depressions 204.

As illustrated in FIG. 3, hinge 108 completely bifurcates the deltoid cover 112 effectively separating the hook and loop area (that would be situated when worn at about the clavicle) from the area that would cover the front of the deltoid. As shown in FIG. 3, the hook and loop area may be expanded to cover substantially all of the upper area of the pad 100 on the left side of hinge 108. FIG. 3 further illustrates a set of vertical depressions 204 running from the top portion of the pad to the bottom portion of the pad 100. The combination of diagonal and vertical depressions, form a tributary network of depressions extending laterally and medially to improve the wicking functionality and flexibility of pad 100. In one embodiment, a deltoid channel position and deltoid channel thickness may be adjusted, fitted or customized according to a variety of biometric parameters. As shown in FIG. 3, the pad 100 may include rivet covers, preferably along a central axis of the pad 100, formed in a square shape with circular or oblong rivet depression shapes, as shown. In one embodiment, rivet cover may range in size from 0.5 inches to 0.625 inches, although other embodiments may include larger and smaller rivet covers.

Figure 4:
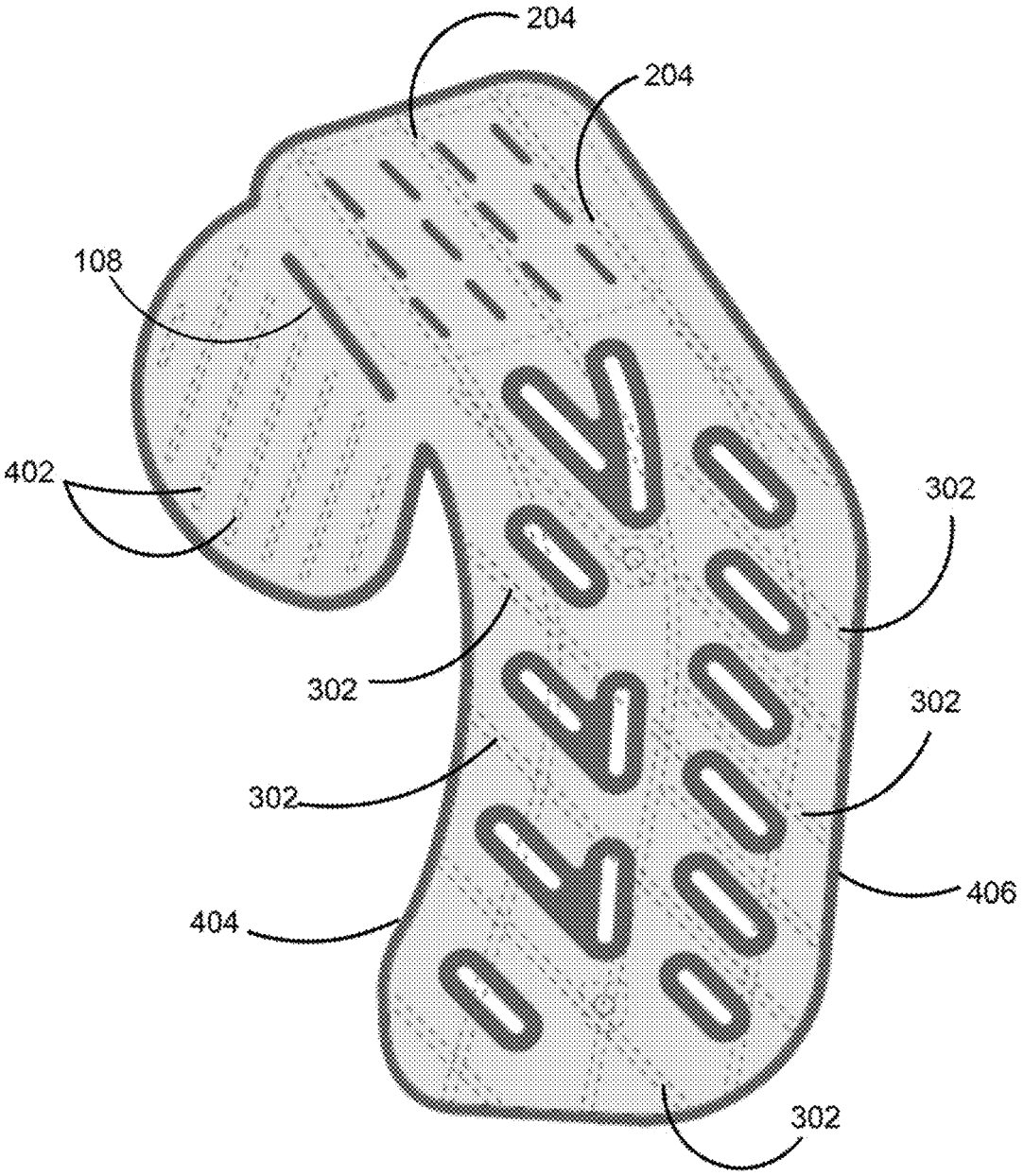
FIG. 4 is a plan view showing a front pad according to at least one other embodiment of the pads disclosed herein for use with protective equipment.
Figure 5:
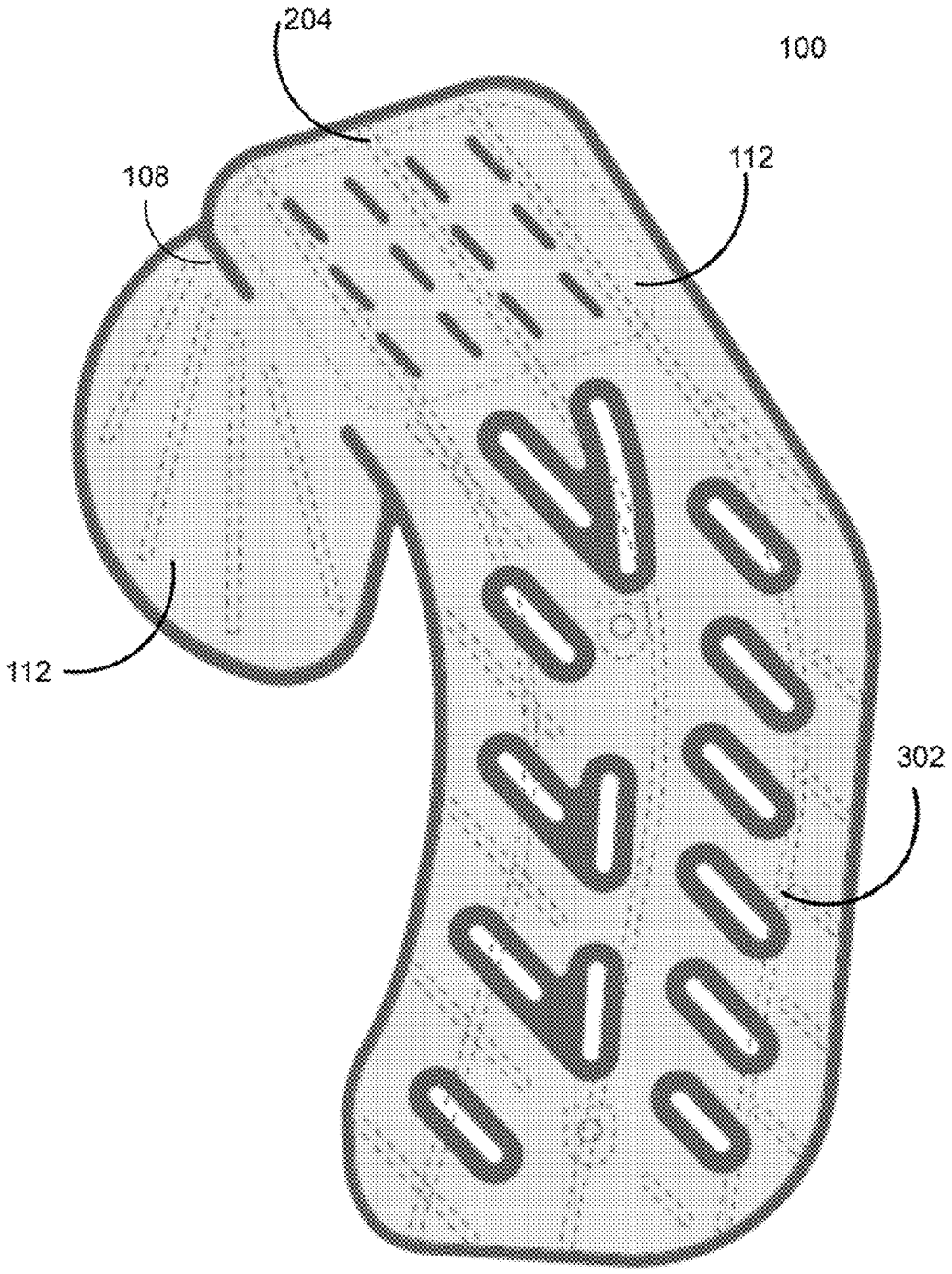
FIG. 5 is a plan view showing a front pad according to at least one other embodiment of the pads disclosed herein for use with protective equipment.

In some embodiments, individual depressions 302, 306 communicate with a plurality of vertical depressions 204, as shown in FIG. 4, while in other embodiments, the depressions 302 communicate with only one vertical depression 204, as shown in FIG. 5. The depressions 302, 306 may cross all vertical depressions 204 and past the perimeter of the pad 100, as shown in FIGS. 6-14. This arrangement further enhances moisture removal from the system by directing the moisture from depression 302 to the depressions 204 and/or to the slots 104, 106, and through the apertures therein, and thus outward from the padding system. When combined with the shoulder pad shell, the depressions 204, 302 form a network of conduits to move moisture away from the user. The depth of the depression(s) 302 may vary as well, but are generally less than 50%, or preferably less than 30% of the thickness of the foam 102. The depressions 302 may be the same depth or less than the depth of depressions 204 to further enhance moisture movement away from the shoulder pads. When combined with the low or no permeability outer layers, the pad 100 successfully minimizes or eliminates moisture absorption and/or retention.

Referring to FIG. 4, hinge 108 may be formed centrally between the deltoid cover 112 and main body of the pad, without connection to the top or lower outside portion of the deltoid cover 112. Instead of the arched depressions shown in FIGS. 1 and 3, FIG. 4 depicts another embodiment where the depressions 402 on one side of the hinge 108 are diagonal, forming a reflex angle (more than 90 degrees) when considered relative to hinge 108.

Focusing on FIG. 4, the pad 100 may include three vertical depressions 204 running the length of the pad 100 from the top to the bottom. The vertical tributary depressions function to deliver moisture to the slotted cut-outs/punch-outs, and ultimately away from an individual's body. Also shown in FIG. 4 are a plurality of intersecting diagonal depressions 302, crossing a plurality of the vertical depressions 204, in this embodiment, all three vertical depressions, and angled in a manner substantially parallel to at least one row of the slotted flanges/cut-outs/punch-outs. In this embodiment, a majority of the diagonal depressions 304 extend from the farthest lateral end 404 to the medial end 406 of the pad 100. The number and extent of the diagonal depressions 304 improves the flexibility of the pad 100 overall. FIG. 4 further depicts a half oval shaped rivet cover.

Referring to FIG. 5, and described similarly with FIG. 2, hinge 108 may be formed with two segments. On one side of hinge 108, a plurality of depressions run in a quasi-vertical manner on the deltoid cover 112. The pad 100 further includes three or more longitudinal vertical depressions 204 running the length of pad 100. As noted above, the vertical depressions along with the diagonal depressions form a tributary network that function to deliver moisture to the slotted flanges and ultimately away from an individual's body. FIG. 5 further illustrates a plurality of intersecting depressions 302 which may or may not intersect with the vertical depressions.

Figure 6:
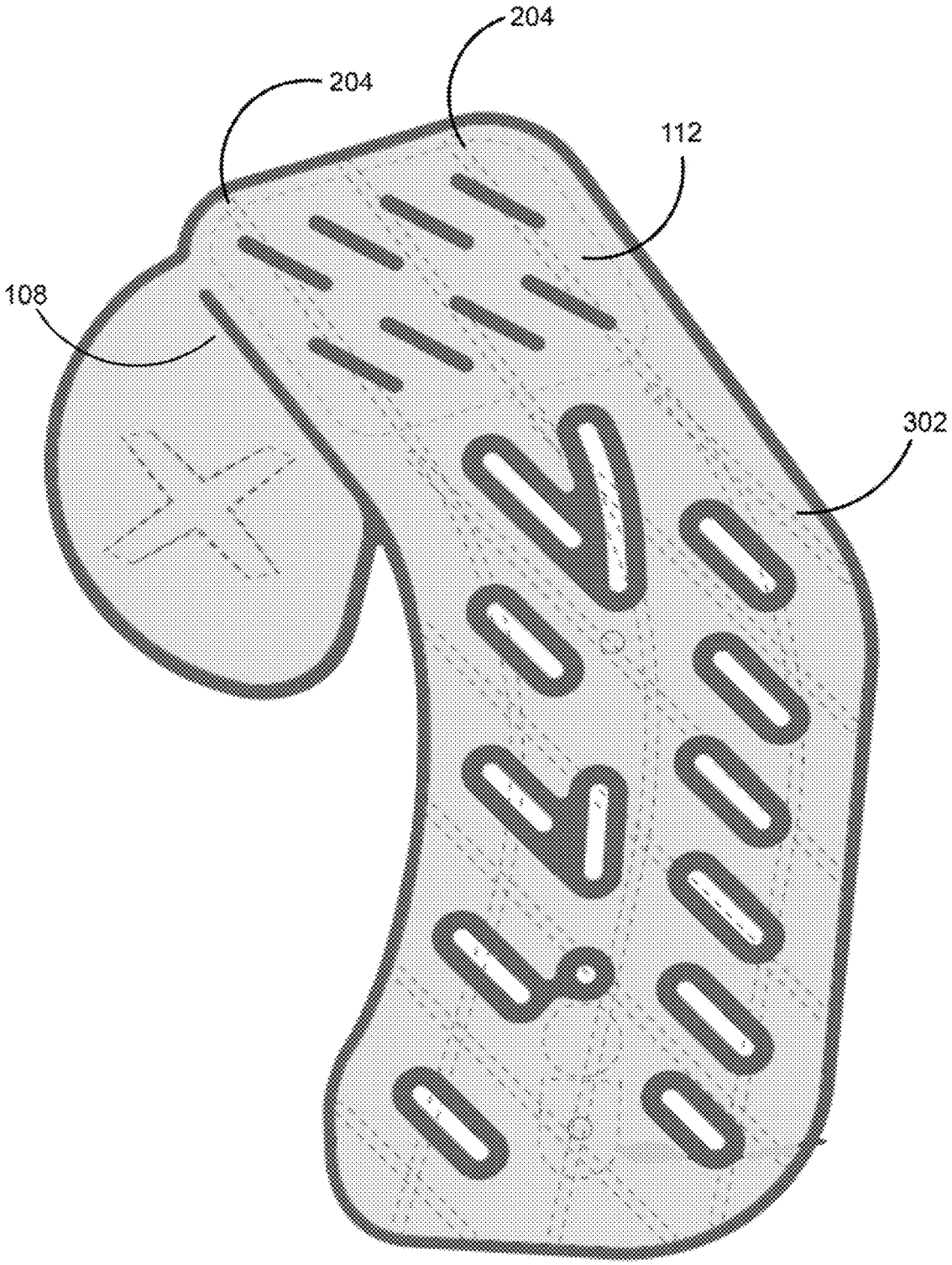
FIG. 6 is a plan view showing a front pad according to at least one other embodiment of the pads disclosed herein for use with protective equipment.

Referring to FIG. 6, hinge 108 may be formed with one segment running from the bottom edge of deltoid cover 112 towards approximately the top edge of deltoid cover 112. The hinge 108 functions to bifurcate the deltoid cover 112 effectively separating the hook and loop area from an area containing at least one design depression shape. The pad 100 may further include a plurality of longitudinal tributary depressions 204, 302 running the length of pad 100 (that is from top to bottom, and medially. FIG. 6 further illustrates a plurality of intersecting depressions wherein at least one intersecting depression crosses each of the plurality of longitudinal tributary depressions 204. In addition, FIG. 6 shows at least one rivet cover 208, at least one circular depression and a circular hole.

Figure 7:
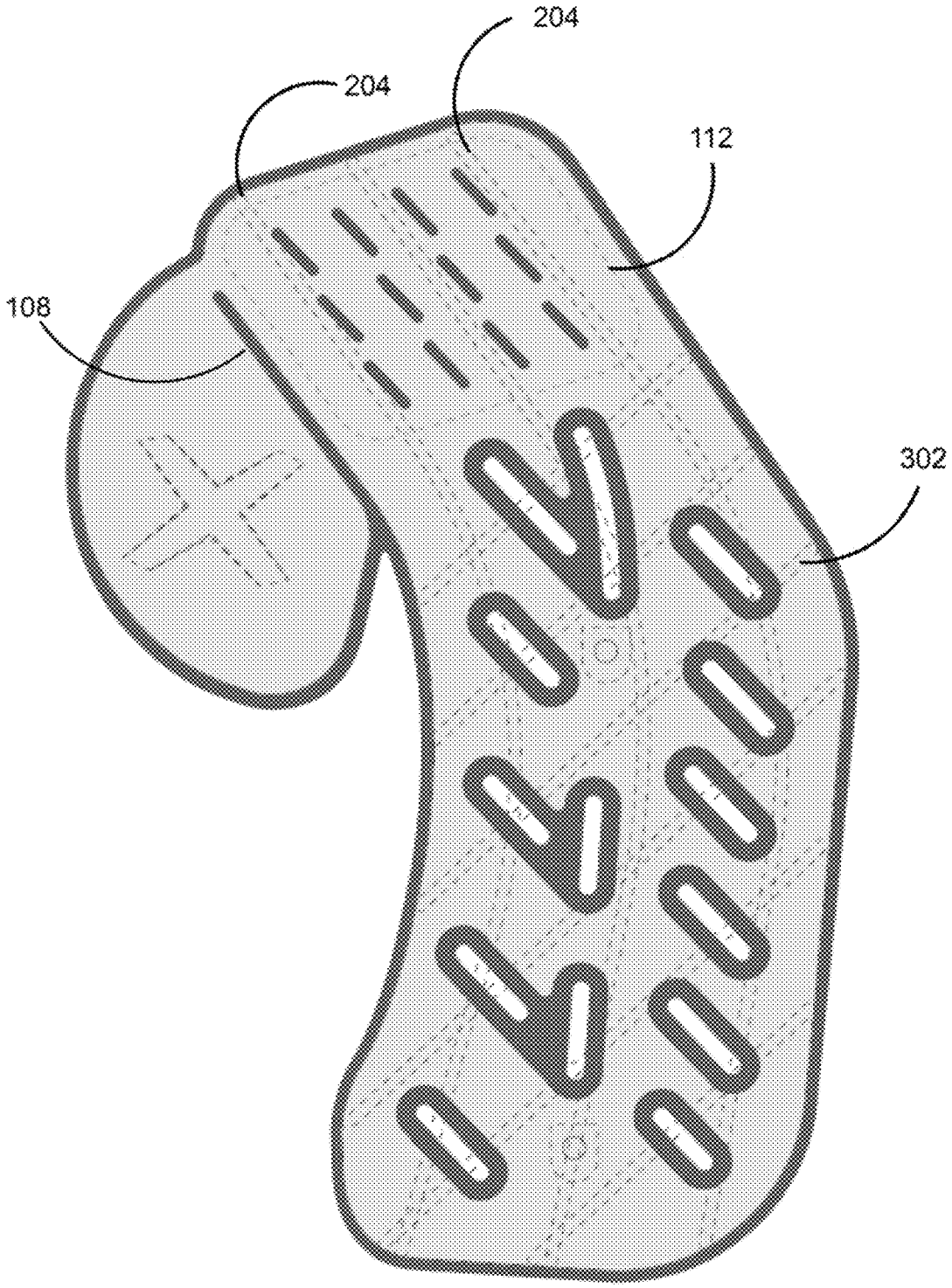
FIG. 7 is a plan view showing a front pad according to at least one other embodiment of the pads disclosed herein for use with protective equipment.

FIG. 7 illustrates pad 100 with a hinge 108 formed with one segment running from the bottom of deltoid cover 112 towards approximately the top of deltoid cover 112. The hinge 108 functions to bifurcate the deltoid cover 112 effectively separating the hook and loop area from an area containing at least one design depression shape. The pad 100 may further include a plurality of vertical tributary depressions 204 running the length of pad 100 from the top to the bottom. FIG. 7 further illustrates a plurality of intersecting diagonal depressions 302 forming a crosshatch pattern with the longitudinal tributary depressions. In this embodiment the diagonal depressions 302 are oriented upward medially, pointing away from the center of the shoulder pads.

Figure 8:
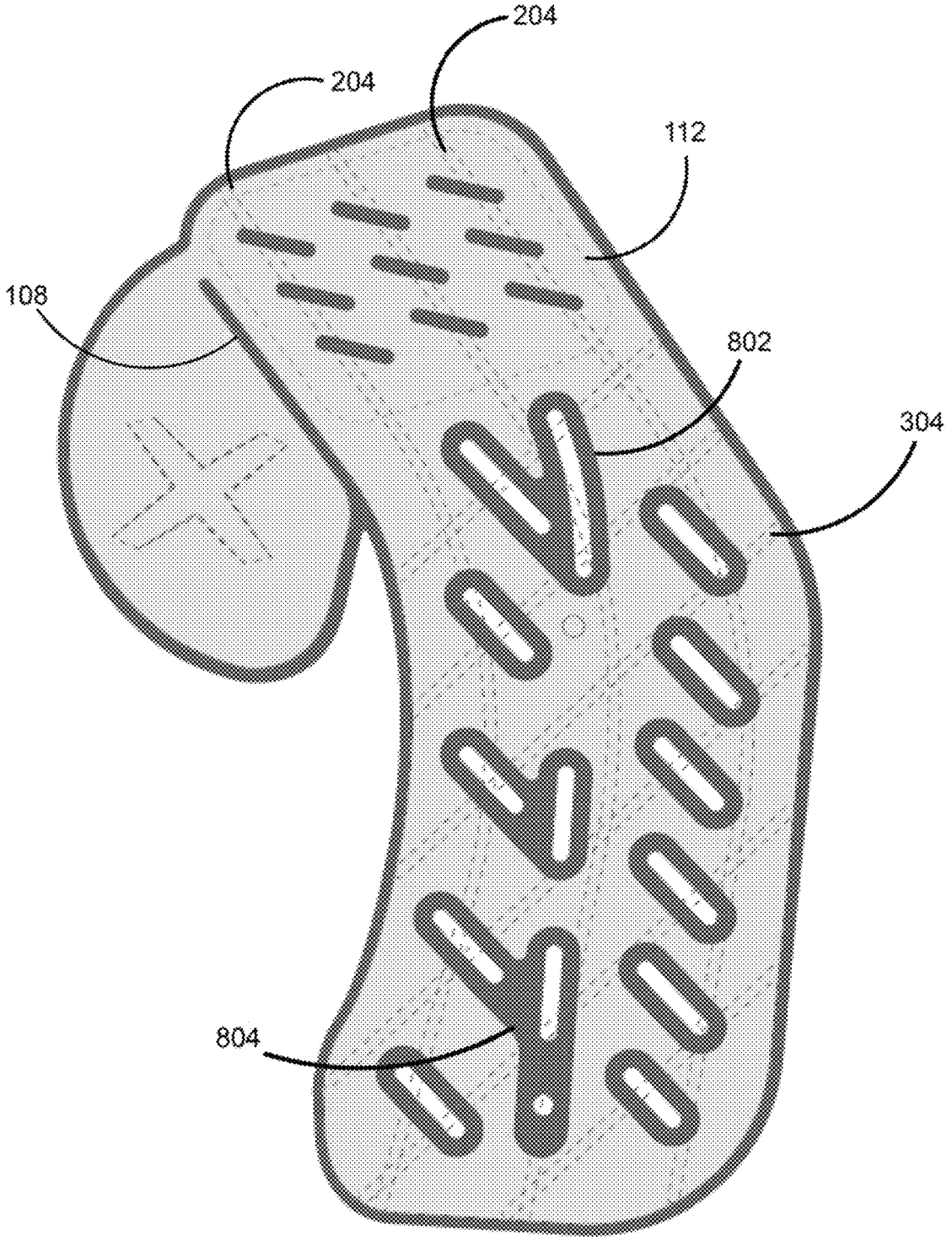
FIG. 8 is a plan view showing a front pad according to at least one other embodiment of the pads disclosed herein for use with protective equipment.

FIG. 8 illustrates pad 100 with a hinge 108 formed with one segment running from the bottom of deltoid cover 112 towards approximately the top of deltoid cover 112. The hinge 108 functions to bifurcate the deltoid cover 112 effectively separating the hook and loop area from an area in the deltoid cover containing at least one design depression shape. The pad 100 may further include a plurality of vertical tributary depressions 204 running the length of pad 100, as discussed above. FIG. 8 further illustrates a plurality of intersecting diagonal depressions forming a crosshatch pattern with the longitudinal tributary depressions oriented away from the center of the shoulder pads.

Additionally, FIG. 8 illustrates an advantageous aspect of pad 100. In this embodiment, the slotted flanges may be formed so that the flanges appear in a V shape 802 directing moisture away from the body of the user, where the slots themselves do not intersect. Further, two slotted flanges may be formed together to create an obtuse angle 804.

Figure 9:
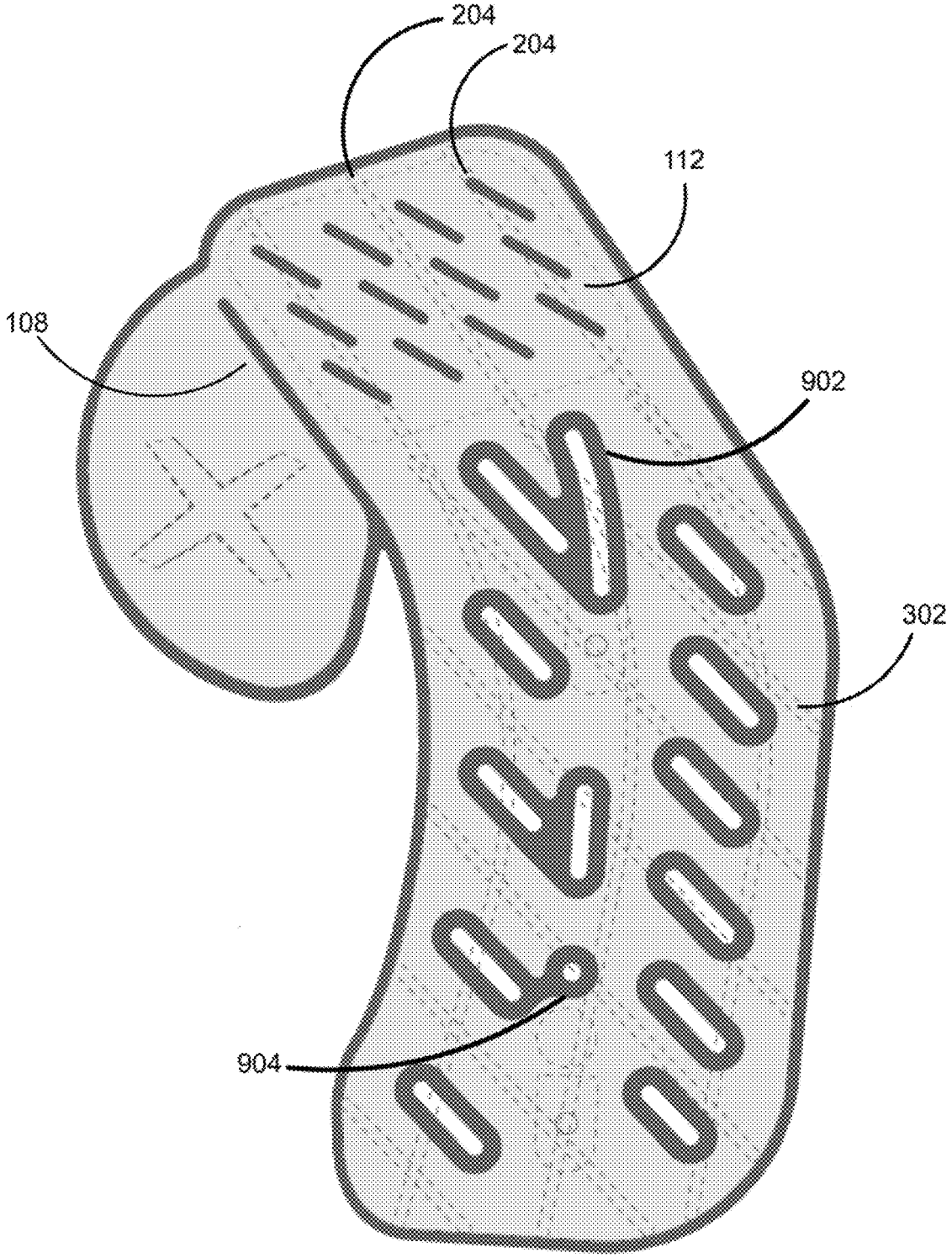
FIG. 9 is a plan view showing a front pad according to at least one other embodiment of the pads disclosed herein for use with protective equipment.

FIG. 9 illustrates pad 100 with a hinge 108 formed with one segment running from the bottom of deltoid cover 112 towards approximately the top of deltoid cover 112. The hinge 108 functions to bifurcate the deltoid cover 112 effectively separating the hook and loop area from an area containing at least one design depression shape. The pad 100 may further include a plurality of vertical tributary depressions 204 running the length of pad 100. FIG. 9 further illustrates a plurality of intersecting depressions forming a crosshatch pattern with the longitudinal tributary depressions.

Additionally, FIG. 9 illustrates an advantageous aspect of pad 100. In this embodiment, the slotted flanges may be formed in a V shape 902 directing moisture away from the body of the user. Further, two slotted flanges may be configured in a manner where a diagonal oriented slotted flange is directly incorporated with a circular flange with a circular cutout 904.

Figure 10:
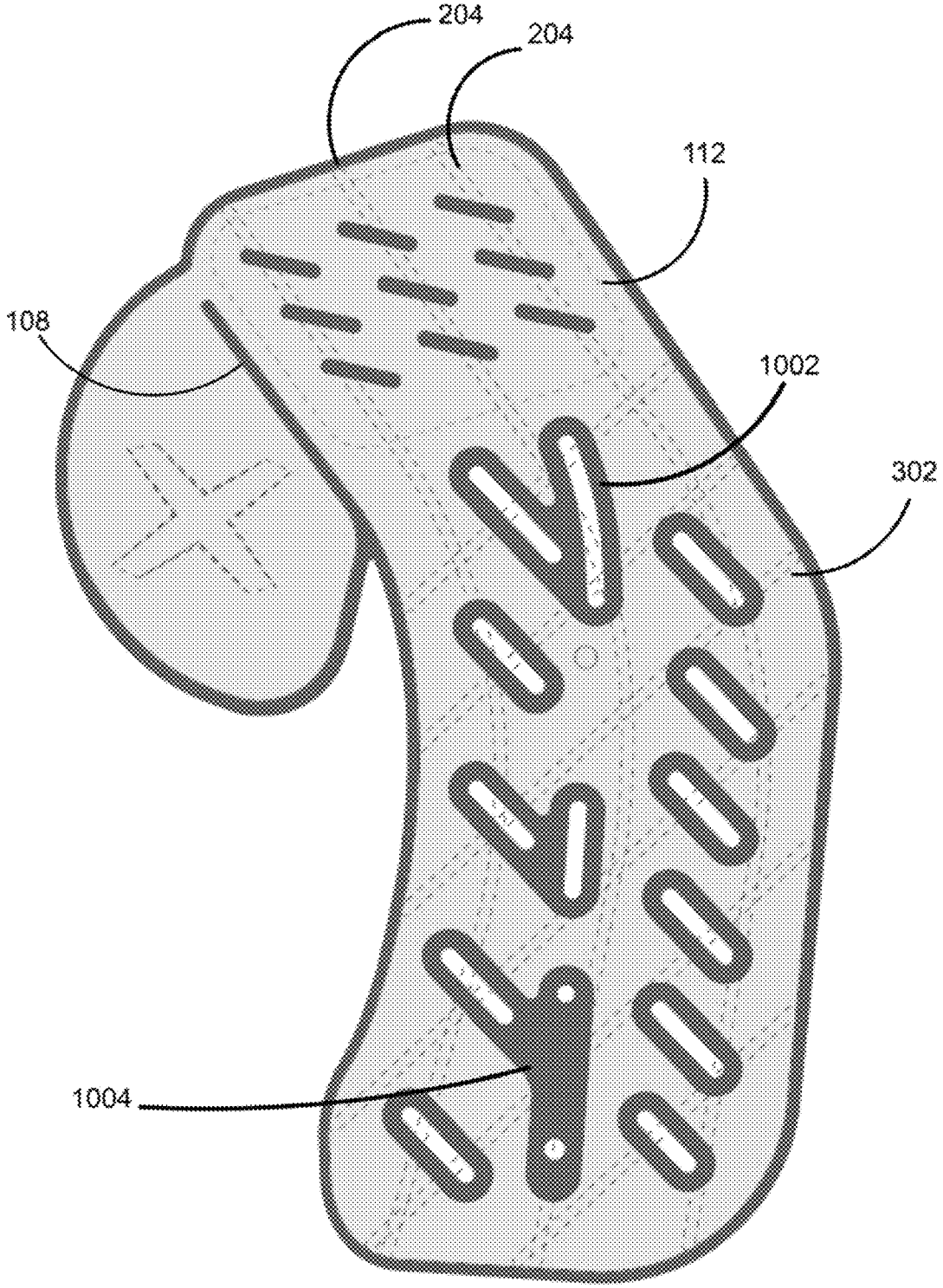
FIG. 10 is a plan view showing a front pad according to at least one other embodiment of the pads disclosed herein for use with protective equipment.

FIG. 10 illustrates pad 100 with a hinge 108 formed with one segment running from the bottom of deltoid cover 112 towards approximately the top of deltoid cover 112. The hinge 108 functions to bifurcate the deltoid cover 112 effectively separating the hook and loop area from an area containing at least one design depression shape. The pad 100 may further include a plurality of vertical tributary depressions 204 running the length of pad 100. FIG. 10 further illustrates a plurality of intersecting depressions forming a crosshatch pattern with the longitudinal tributary depressions.

Additionally, FIG. 10 illustrates an advantageous aspect of pad 100. In this embodiment, the oblong flanges may be formed in a V shape 1002 directing moisture away from the body of the user. Further, two oblong flanges may be configured in a manner where a diagonal oriented oblong flange is directly incorporated with an oblong flange including two circular cutouts 1004.

Figure 11:
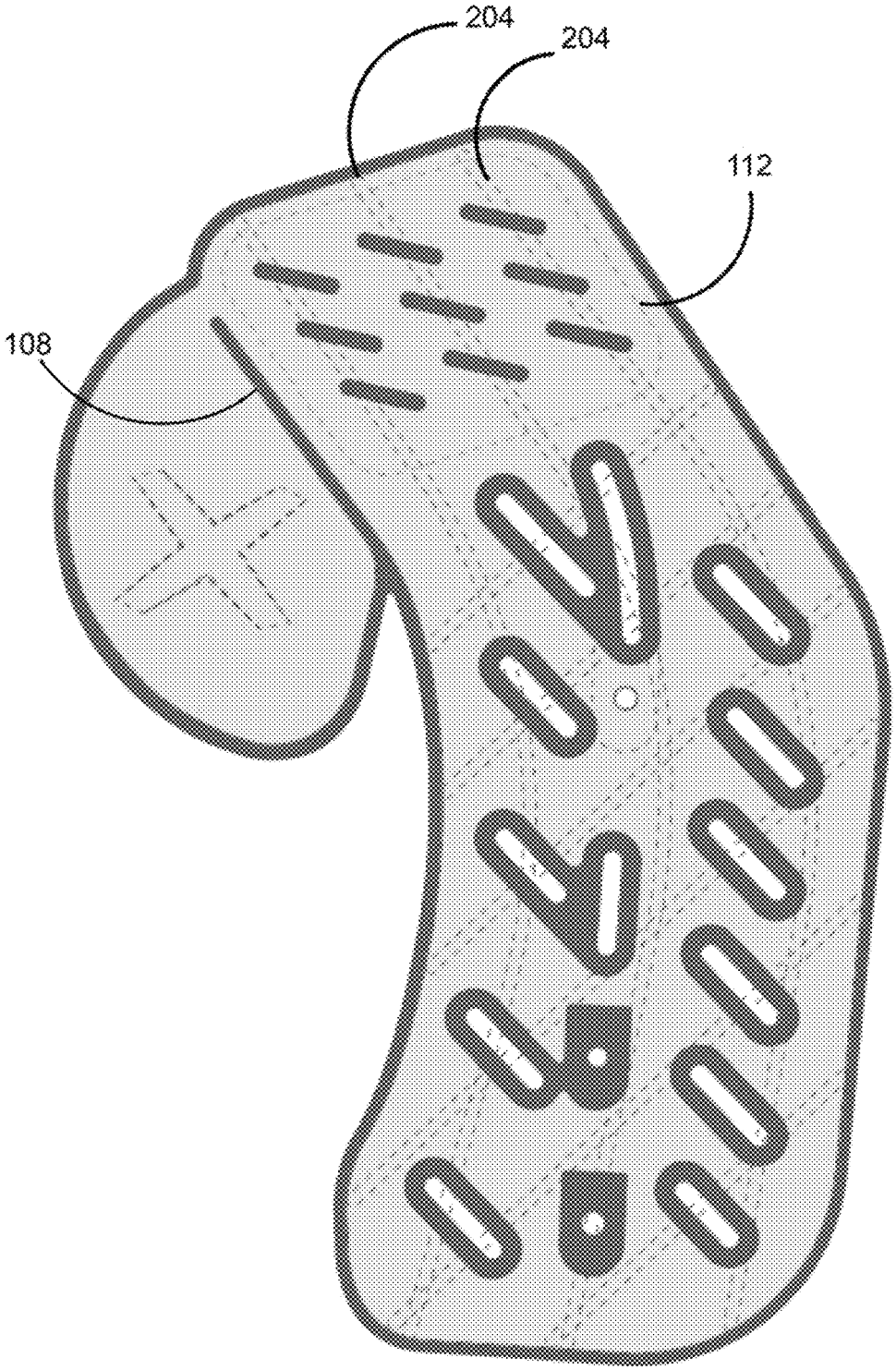
FIG. 11 is a plan view showing a front pad according to at least one other embodiment of the pads disclosed herein for use with protective equipment.

FIG. 11 illustrates pad 100 with a hinge 108 formed with one segment running from the bottom of deltoid cover 112 towards approximately the top of deltoid cover 112. The hinge 108 functions to bifurcate the deltoid cover 112 effectively separating the hook and loop area from an area containing at least one design depression shape. In the embodiment depicted in FIG. 11, the hook and loop area may include a plurality of diagonally oriented oblong cutouts forming three rows. The pad 100 may further include a plurality of vertical tributary depressions 204 running the length of pad 100. FIG. 11 further illustrates a plurality of intersecting diagonal depressions forming a crosshatch pattern with the longitudinal tributary depressions.

Figure 12:
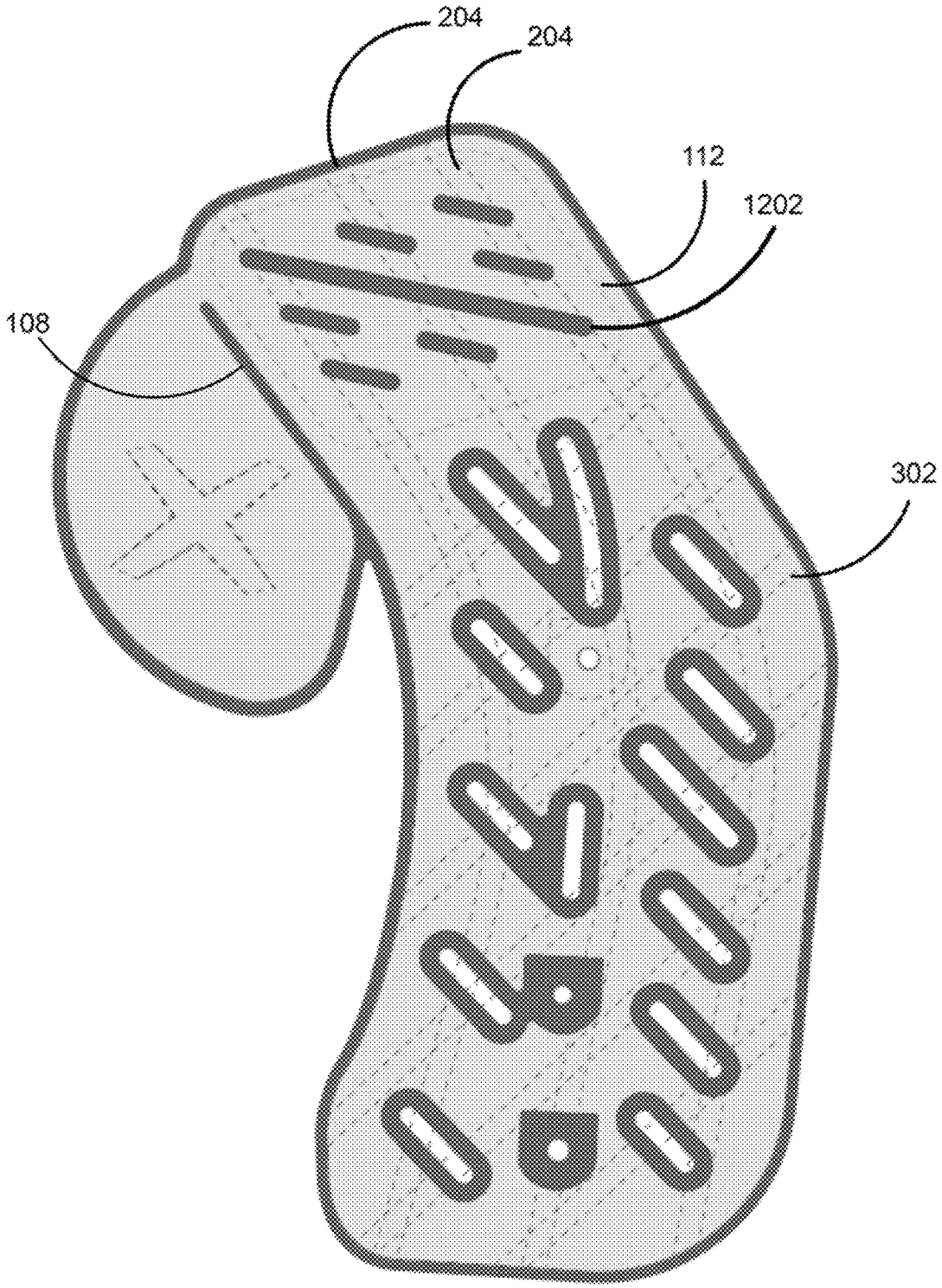
FIG. 12 is a plan view showing a front pad according to at least one other embodiment of the pads disclosed herein for use with protective equipment.

FIG. 12 illustrates pad 100 with a hinge 108 formed with one segment running from the bottom of deltoid cover 112 towards approximately the top of deltoid cover 112. The hinge 108 functions to bifurcate the deltoid cover 112 effectively separating the hook and loop area from an area containing at least one design depression shape. In the embodiment depicted in FIG. 12, the hook and loop area may include a plurality of diagonally oriented oblong cutouts wherein one of the oblong cutouts diagonally bisects the hook and loop area 1202. The pad 100 may further include a plurality of vertical tributary depressions 204 running the length of pad 100. FIG. 12 further illustrates a plurality of intersecting diagonal depressions forming a crosshatch pattern with the longitudinal tributary depressions.

Figure 13:
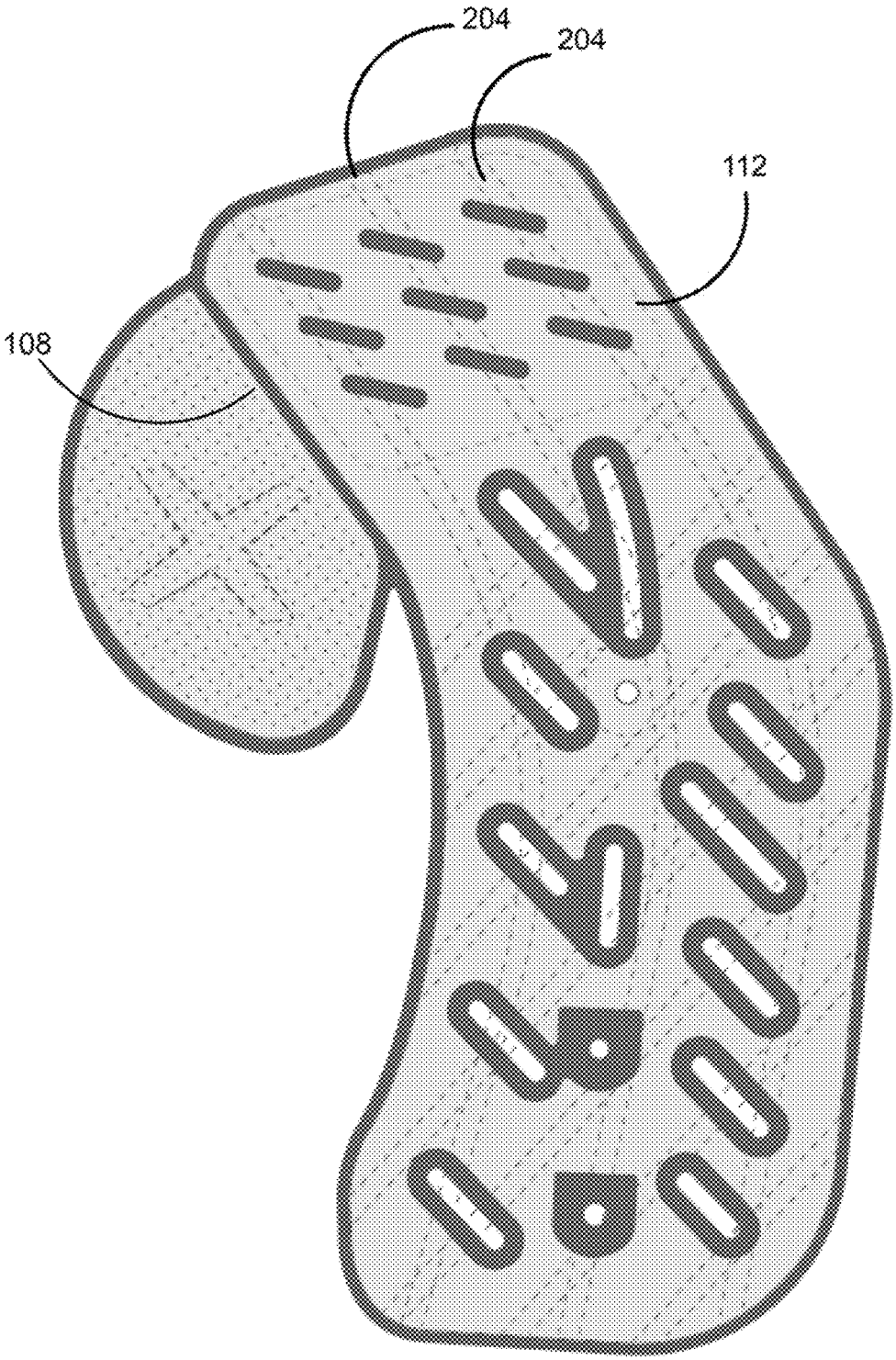
FIG. 13 is a plan view showing a front pad according to at least one other embodiment of the pads disclosed herein for use with protective equipment.

FIG. 13 illustrates pad 100 with a hinge 108 completely bifurcates the deltoid cover 112 effectively separating the hook and loop area from an area containing at least one design depression shape. In the deltoid cover area containing at least one design depression shape, there may be a ventilation pattern spacing depression dots throughout the area. In the embodiment depicted in FIG. 13, the hook and loop area may include a plurality of diagonally oriented oblong cutouts. The pad 100 may further include a plurality of vertical tributary depressions 204 running the length of pad 100. FIG. 13 further illustrates a plurality of intersecting diagonal depressions forming a crosshatch pattern with the longitudinal tributary depressions.

Figure 14:
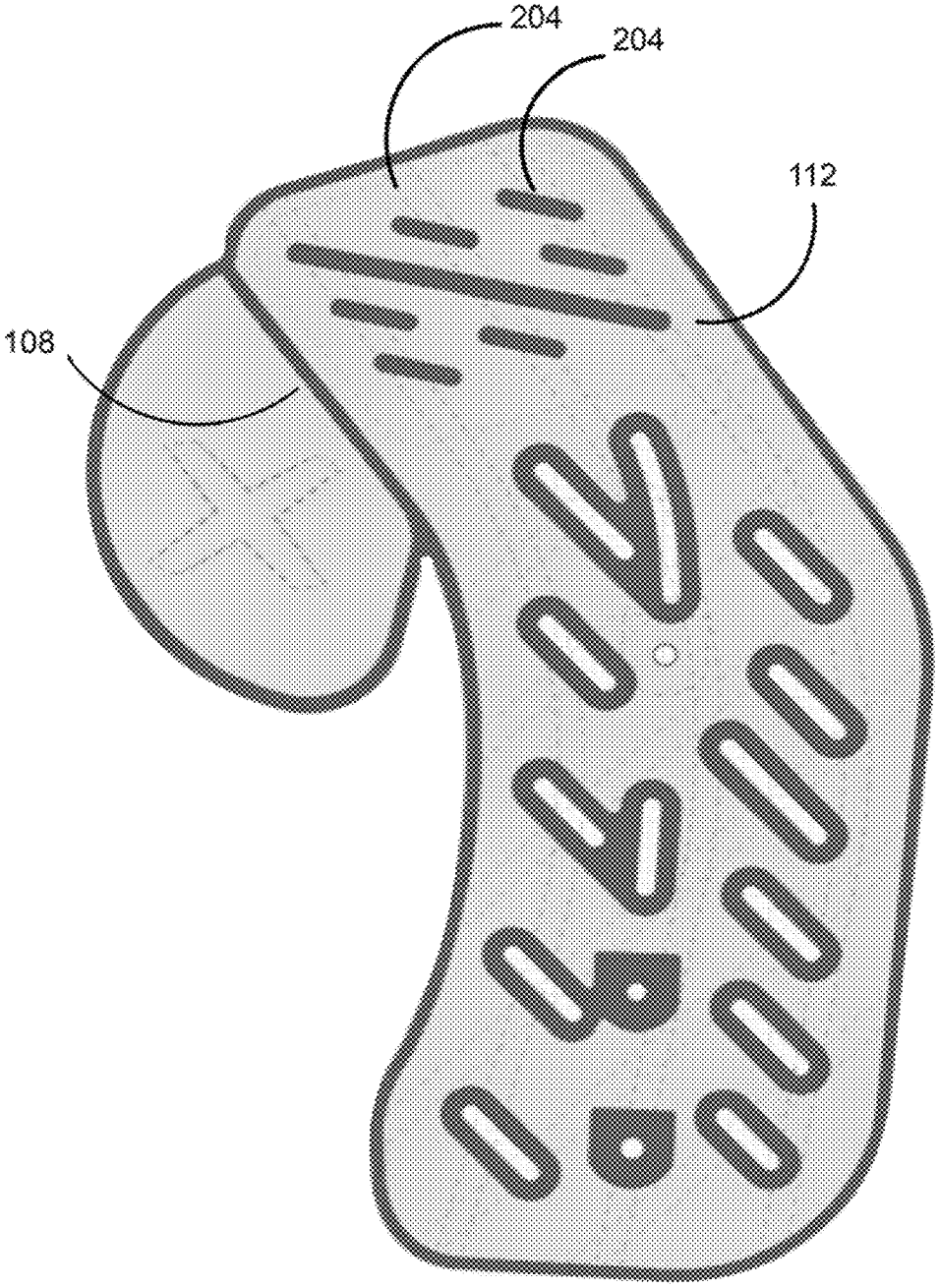
FIG. 14 is a plan view showing a front pad according to at least one other embodiment of the pads disclosed herein for use with protective equipment.

FIG. 14 illustrates pad 100 with a hinge 108 completely bifurcates the deltoid cover 112 effectively separating the hook and loop area from an area containing at least one design depression shape. In the embodiment depicted in FIG. 14, the hook and loop area may include a plurality of diagonally oriented oblong cutouts wherein one of the oblong cutouts diagonally bisects the vertical depressions 204 in the hook and loop area. The pad 100 may further include a plurality of longitudinal tributary depressions 204 running the length of pad 100. FIG. 14 further illustrates a plurality of intersecting depressions forming a crosshatch pattern with the longitudinal tributary depressions.

While the foregoing invention has been described in some detail for purposes of clarity and understanding, it will be appreciated by one skilled in the art, from a reading of the disclosure, that various changes in form and detail can be made without departing from the true scope of the invention.

What is claimed it:

1. A pad for protective equipment, the pad comprising:

a foam layer having a cantilever shape with an inner face and an outer face opposite the inner face, a top and a bottom opposite the top, and a medial end and a lateral end opposite the medial end, wherein at least one of the inner face and the outer face comprise at least one vertical depression extending between at least a portion of the top and the bottom of the foam layer, and extending through to the bottom of the foam layer, the foam layer further having at least one slotted aperture therein extending through the inner face and the outer face, the at least one vertical depression intersecting with the at least one slotted aperture; and wherein the foam layer comprises a second vertical depression, and wherein the foam layer has a plurality of the slotted apertures, including a first set of slotted apertures arranged in a first column and a second set of slotted apertures arranged in a second a column, wherein at least one of the first set of slotted apertures intersects with the at least one vertical depression, and wherein at least one of the second set of slotted apertures intersects with the second vertical depression and wherein at least one of the first set of slotted apertures has a flange that intersects with a flange of at least one of the second set of slotted apertures to form a V shape.

2. The pad for protective equipment of claim 1, wherein the foam layer comprises at least one diagonal depression and wherein the at least one vertical depression intersects with the at least one diagonal depression.

3. The pad for protective equipment of claim 1, wherein the foam layer comprises at least one diagonal depression and wherein the at least one diagonal depression is oriented downward medially toward a center of the foam layer.

4. The pad for protective equipment of claim 1, wherein the foam layer comprises at least one diagonal depression and wherein the at least one diagonal depression is oriented upward medially away from a center of the foam layer.

5. The pad for protective equipment of claim 1, wherein the foam layer comprises a plurality of diagonal depressions and wherein the at least one vertical depression intersects with the at least one diagonal depression of the plurality of diagonal depressions and wherein at least one other of the plurality of diagonal depressions does not intersect with the at least one vertical depression.

6. The pad for protective equipment of claim 5, wherein the at least one of the plurality of diagonal depressions extends to the lateral end and wherein a remaining plurality of diagonal depressions extends to the medial end.

7. The pad for protective equipment of claim 1, further comprising a deltoid cover hingedly coupled to the foam layer, wherein the deltoid cover comprises at least one depression therein extending radially outward from the pad.

8. The pad for protective equipment of claim 1, wherein the foam layer comprises a second vertical depression on an opposite face from the at least one vertical depression, the second vertical depression extending between at least a portion of the top and the bottom of the foam layer, and extending through to the bottom of the foam layer, the second depression interesting with the at least one slotted aperture.

9. The pad for protective equipment of claim 1, wherein the at least one slotted aperture is surrounded at least partially by a slotted flange.

10. The pad for protective equipment of claim 1, wherein at least one of the first set of slotted apertures is parallel to at least one of the second set of slotted apertures.

11. The pad for protective equipment of claim 1, wherein the foam layer comprises a plurality of vertical depressions and a plurality of diagonal depressions forming a tributary network extending laterally and medially for wicking moisture.

12. The pad for protective equipment of claim 11, wherein the tributary network intersects to form a crosshatch pattern.

13. The pad for protective equipment of claim 1, further comprising a hook and loop area removably connecting the pad to another pad adapted to extend over a user's shoulder.

14. The pad for protective equipment of claim 1, wherein the foam layer comprises at least one diagonal depression and wherein the at least one vertical depression intersects with the at least one diagonal depression, and wherein the at least one diagonal depression does not intersect the at least one slotted aperture.

* * * * *